US009434168B2

(12) United States Patent
Miyajima

(10) Patent No.: US 9,434,168 B2
(45) Date of Patent: Sep. 6, 2016

(54) LIQUID EJECTING APPARATUS

(71) Applicant: SEIKO EPSON CORPORATION, Tokyo (JP)

(72) Inventor: Hiroki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/627,077

(22) Filed: Feb. 20, 2015

(65) Prior Publication Data

US 2015/0246541 A1 Sep. 3, 2015

(30) Foreign Application Priority Data

Feb. 28, 2014 (JP) ..... 2014-039406

(51) Int. Cl.
*B41J 2/165* (2006.01)
*B41J 2/14* (2006.01)

(52) U.S. Cl.
CPC ..... *B41J 2/16511* (2013.01); *B41J 2/14233* (2013.01); *B41J 2/16508* (2013.01); *B41J 2002/14362* (2013.01); *B41J 2002/14419* (2013.01); *B41J 2002/14491* (2013.01)

(58) Field of Classification Search
CPC ..... B41J 2/16505; B41J 2/16511; B41J 2/14233; B41J 2/16508; B41J 2002/14362; B41J 2002/14419; B41J 2002/14491
USPC ..... 347/32, 29
See application file for complete search history.

(56) References Cited

U.S. PATENT DOCUMENTS 5,055,856 A * 10/1991 Tomii ..... B41J 2/16523 347/30
6,481,826 B1 * 11/2002 Hara et al. ..... 347/29
2003/0058301 A1 * 3/2003 Sekiya ..... B41J 2/16552 347/29
2004/0001117 A1 * 1/2004 Choy et al. ..... 347/29
2004/0263559 A1 12/2004 Yoshida et al.
2007/0165070 A1 * 7/2007 Honma et al. ..... 347/47
2013/0050333 A1 * 2/2013 Tanaka ..... B41J 25/308 347/29

FOREIGN PATENT DOCUMENTS

JP 2011-073229 4/2011

* cited by examiner

*Primary Examiner* — Stephen Meier
*Assistant Examiner* — Alexander D Shenderov
(74) *Attorney, Agent, or Firm* — Workman Nydegger

(57) ABSTRACT

A liquid ejecting apparatus includes a liquid ejecting head and that includes nozzle openings through which liquid is ejected. A positioning abutting unit is arranged on an outer side of a region in which a plurality of the nozzle openings are formed. A cap main body is arranged so as to relatively move with respect to the liquid ejecting head. The cap main body has a side wall. A sealing member is accommodated inside the cap main body, comes into contact with the positioning abutting unit in a state of surrounding the region due to the relative movement of the liquid ejecting head and the cap main body, and forms a sealed space inside of the cap main body.

7 Claims, 13 Drawing Sheets

LIQUID EJECTING APPARATUS

CROSS-REFERENCE TO RELATED APPLICATIONS

The present application claims priority to Japanese Patent Application No. 2014-039406 filed on Feb. 28, 2014, which is hereby incorporated by reference in its entirety.

BACKGROUND

1. Technical Field

The present invention relates to a liquid ejecting apparatus which includes a liquid ejecting head, and a cap main body for capping the liquid ejecting head.

2. Related Art

As a liquid ejecting apparatus, for example, there is an ink jet recording apparatus which includes an ink jet recording head discharging ink which is liquid as ink droplets, and performs recording of an image, or the like, by forming dots by causing ink droplets which are discharged from a nozzle of the ink jet recording head to land on a medium for ejecting such as a recording sheet, or the like.

In such an ink jet recording apparatus, a cap main body for suctioning thickened ink and ink into which foreign substances such as air bubbles or dust are mixed from a nozzle opening is provided (refer to JP-A-2011-73229).

In the cap main body, a convex portion is provided in a support frame which supports the ink jet recording head, a concave portion is provided in a cap thermal insulation body, and positioning of both is performed by causing the convex portion to be fitted in the concave portion.

However, since a sealing member which is provided in the cap main body seals a liquid ejecting face of the ink jet recording head by being in contact therewith, when positioning the cap main body in the support frame, or the like, a dimensional tolerance of a member such as a member which configures the ink jet recording head, or the support frame, or errors which are caused by a position shift therebetween are integrated, and there is a concern that a big error may occur when positioning the sealing member in a sealing region.

In addition, in order to reliably seal a nozzle opening even when the sealing member is shifted, a blank space portion with which the sealing member comes into contact should become large, and there is a problem in that the ink jet recording head becomes large.

In addition, such a problem is not limited to the ink jet recording apparatus, and is similarly present in a liquid ejecting apparatus which ejects liquid other than ink.

SUMMARY

An advantage of some aspects of the invention is to provide a liquid ejecting apparatus which can be miniaturized by improving a positioning accuracy of a cap main body in a liquid ejecting head.

According to an aspect of the invention, there is provided a liquid ejecting apparatus which includes a liquid ejecting head including a liquid ejecting face on which a nozzle opening which ejects liquid is formed, and a positioning abutting unit which is arranged on an outer side of a region in which a plurality of the nozzle openings are formed; a cap main body which is arranged so as to relatively move with respect to the liquid ejecting head, and has a side wall which erects in a direction intersecting the liquid ejecting face; and a sealing member which is arranged by being accommodated inside the cap main body, comes into contact with the positioning abutting unit in a state of surrounding the region due to the relative movement of the liquid ejecting head and the cap main body, and forms a sealed space in an inside of the cap main body, in which relative positions of the liquid ejecting head and the sealing member in a direction which goes along the liquid ejecting face are defined, when the side wall of the cap main body comes into contact with the positioning abutting unit on one side in a direction which goes along a plane direction of the liquid ejecting face.

According to the aspect, since positioning is performed by causing the side wall of the cap main body to come into contact with the positioning abutting unit with which the sealing member comes into contact, and the cap main body is interposed between the sealing member and the positioning abutting unit, it is possible to position the sealing member with respect to the positioning abutting unit with high accuracy by suppressing a big error which occurs when dimensional tolerances of a plurality of components which are interposed, or errors such as a position shift therebetween, or the like, are integrated. Accordingly, it is not necessary to form a surplus region which is provided in consideration of a position shift in the region with which the sealing member comes into contact, and it is possible to miniaturize the liquid ejecting head and the cap main body.

In the liquid ejecting apparatus, the positioning abutting unit may be arranged so as to surround the region, and may include a bent portion at an end portion corresponding to one side in a direction which goes along the plane direction of the liquid ejecting face. In this manner, it is possible to improve rigidity of the positioning abutting unit using the bent portion, and to suppress deformation of the side wall of the cap main body which is caused when the side wall comes into contact with the positioning abutting unit using the bent portion.

In the liquid ejecting apparatus, the positioning abutting unit may include the bent portion, and an abutting face which comes into contact with an inside of the side wall. In this manner, since the side wall and the bent portion perform plane contact, it is possible to maintain positioning with high accuracy by suppressing destruction which is caused when the side wall and the bent portion are rubbed against each other, or the like.

In the liquid ejecting apparatus, the side wall may come into contact with the positioning abutting unit on one side of a relative movement direction between the liquid ejecting head and the medium for ejecting. In this manner, it is possible to miniaturize the liquid ejecting head in the relative movement direction, and to fix a posture of the medium for ejecting with high accuracy by reducing a transport distance of transport units which are provided by interposing the liquid ejecting head therebetween.

In the liquid ejecting apparatus, the positioning abutting unit may include an exposure opening portion which can expose the liquid ejecting face, and the exposure opening portion and the liquid ejecting face may be arranged with a gap therebetween in an in-plane direction of the liquid ejecting face. Accordingly, it is possible to reduce costs by miniaturizing the liquid ejecting face.

In the liquid ejecting apparatus, the positioning abutting unit may be provided with the liquid ejecting face. In this manner, it is possible to reduce costs by reducing the number of components.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

First Embodiment

Figure 1:
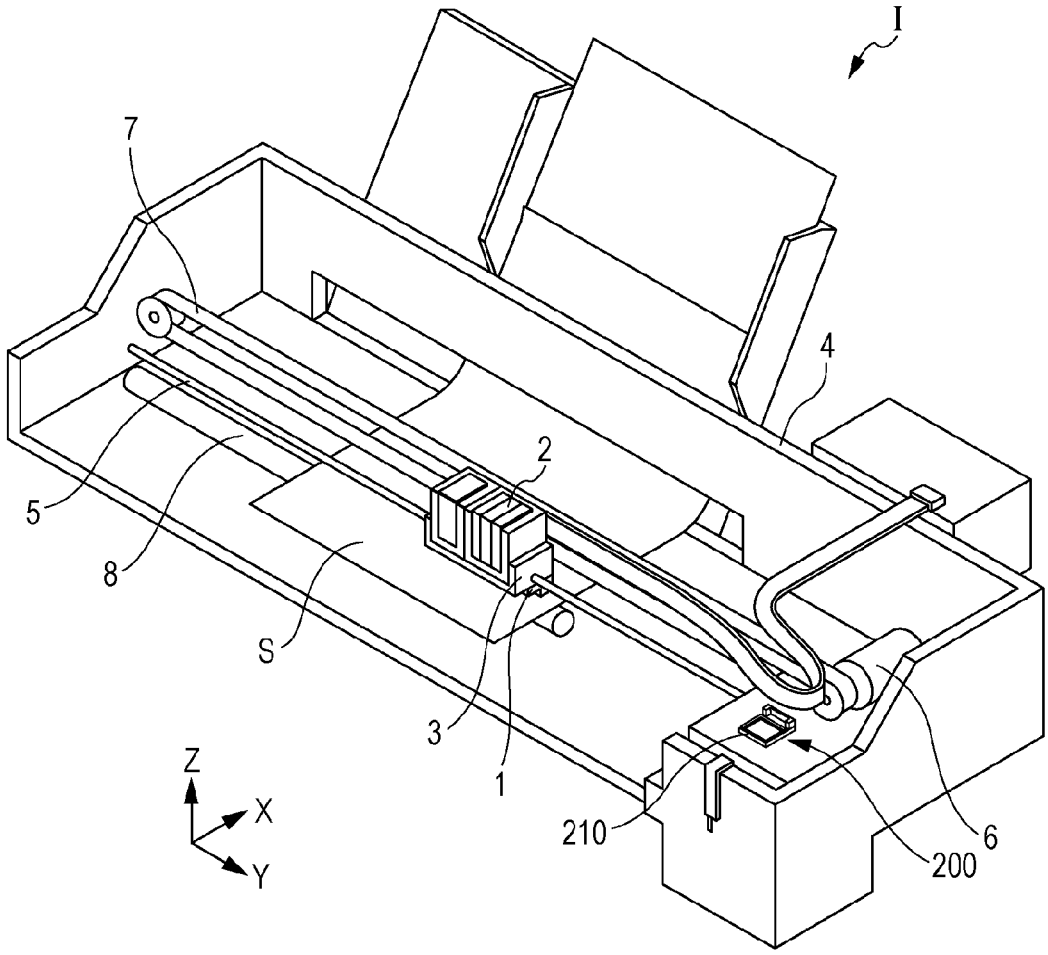
FIG. 1 is a schematic perspective view of a recording apparatus according to a first embodiment.

FIG. 1 is a perspective view of an ink jet recording apparatus which is an example of a liquid ejecting apparatus according to a first embodiment of the invention.

Figure 3:
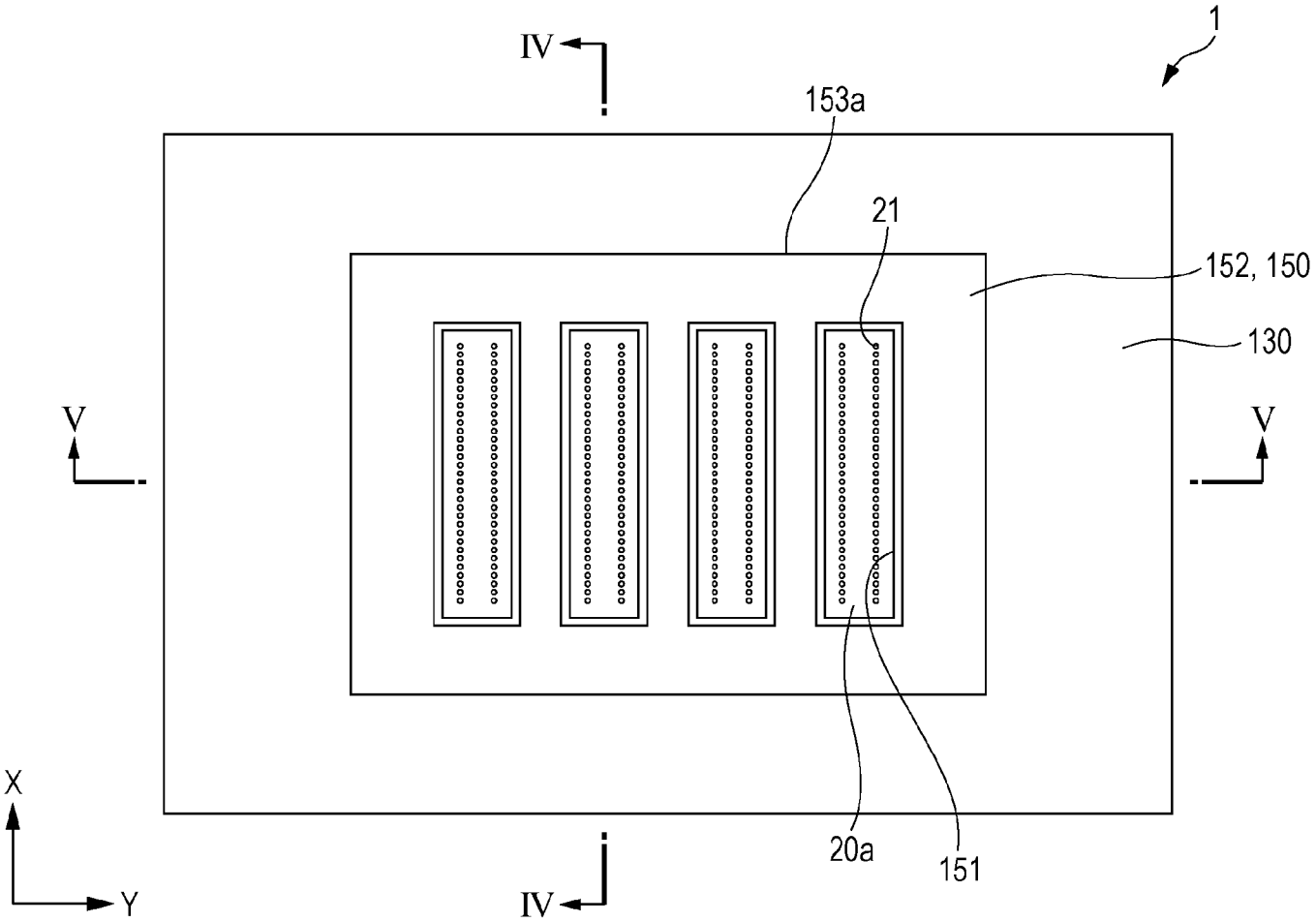
FIG. 3 is a plan view of the recording head according to the first embodiment.

In an ink jet recording apparatus I which is illustrated in FIG. 1, an ink jet recording head 1 is installed in a carriage 3. As illustrated in FIG. 3, a liquid ejecting face 20*a* on which a plurality of nozzle opening 21 are formed is provided on one side face of the ink jet recording head 1. According to the embodiment, a transport direction of a recording sheet S which is a medium for ejecting is referred to as a first direction X. In addition, the carriage 3 is provided in a carriage axis 5 which is attached to an apparatus main body 4 so as to move in an axial direction. According to the embodiment, the axial direction of the carriage axis 5, that is, a movement direction of the carriage 3 is referred to as a second direction Y which intersects the first direction X. In addition, a direction which intersects both the first direction X and the second direction Y is referred to as a third direction Z in the embodiment. In addition, according to the embodiment, for ease of description, a relationship among each direction (X, Y, and Z) is set to be orthogonal; however, the relationship in arrangement of each configuration is not necessarily orthogonal.

In the carriage 3, an ink carriage 2 which is an ink storage unit for supplying ink to the ink jet recording head 1 is detachably provided. In addition, according to the embodiment, a configuration in which the ink carriage 2 is installed in the carriage 3 is exemplified; however, it is not particularly limited to this, and it may be a configuration in which an ink storage unit such as an ink tank is fixed to the apparatus main body 4, and the liquid storage unit and the ink jet recording head 1 are connected through a supply pipe such as a tube.

In addition, the carriage 3 in which the ink jet recording head 1 is installed is moved in the second direction Y along the carriage axis 5 when a driving force of a driving motor 6 is transmitted to the carriage 3 through a plurality of gears (not illustrated) and a timing belt 7.

Meanwhile, a transport roller 8 as a transport unit is provided in the apparatus main body 4, and a recording sheet S which is a recording medium such as paper, or the like, is transported in the first direction X using the transport roller 8. In addition, the transport unit which transports the recording sheet S may be a belt, a drum, or the like, without being limited to the transport roller.

In addition, a home position which is a maintenance position for positioning the carriage 3 when power is off, or the ink jet recording head 1 is subjected to maintenance is provided at one end portion of the carriage 3 of the apparatus main body 4 in the movement direction, that is, in a non-printing region. A maintenance unit 200 for performing various maintenance operations is provided at a position which is the lower part of the home position in the third direction Z so that ejecting of ink droplets from the ink jet recording head 1 is preferably maintained.

Figure 2:
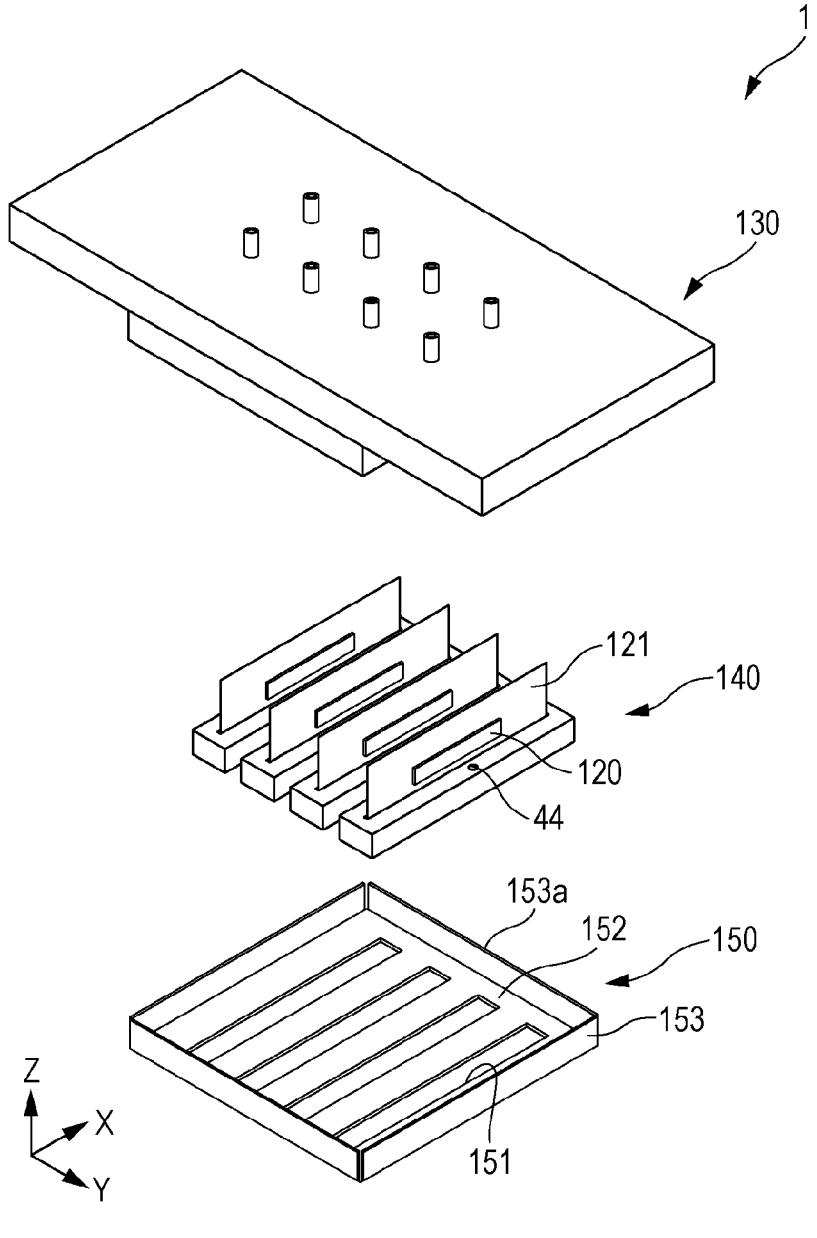
FIG. 2 is an exploded perspective view of a recording head according to the first embodiment.
Figure 4:
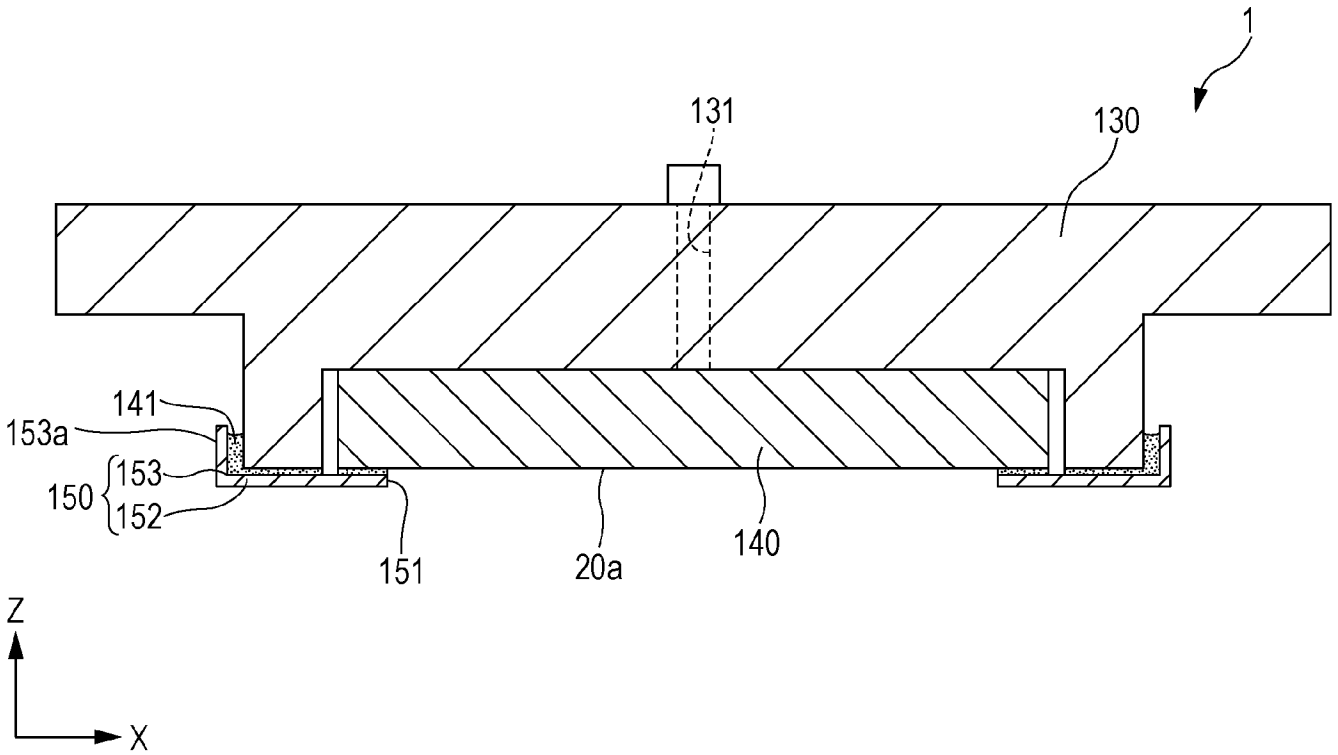
FIG. 4 is a cross-sectional view of the recording head according to the first embodiment.
Figure 5:
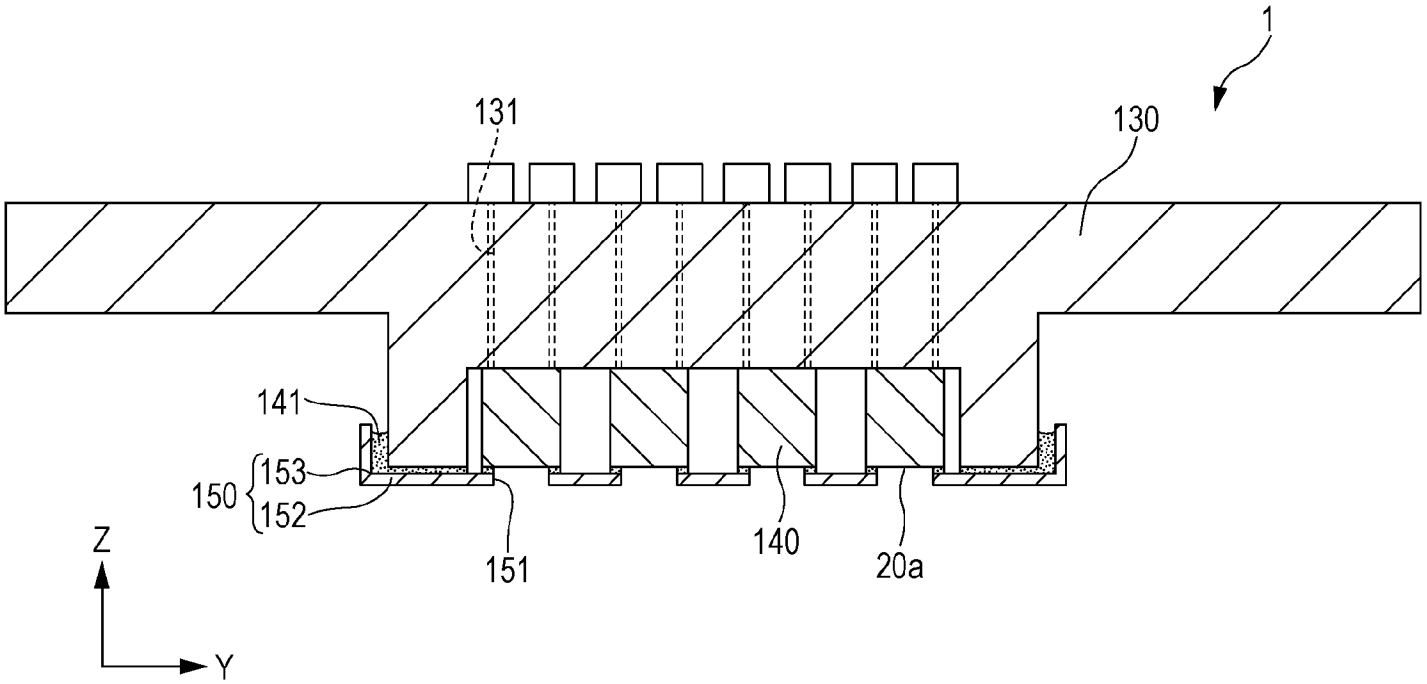
FIG. 5 is a cross-sectional view of the recording head according to the first embodiment.

First, the ink jet recording head 1 according to the embodiment will be described with reference to FIGS. 2 to 4. In addition, FIG. 2 is an exploded perspective view of the ink jet recording head which is an example of the liquid ejecting apparatus according to the embodiment, FIG. 3 is a plan view of the ink jet recording head on the liquid ejecting face side, FIG. 4 is a cross-sectional view which is taken along line IV-IV of FIG. 3, and FIG. 5 is a cross-sectional view which is taken along line V-V of FIG. 3.

As illustrated, the ink jet recording head 1 includes a flow path member 130, a head main body 140, and a cover head 150 which is a positioning abutting unit.

The flow path member 130 is a member on which an ink carriage is mounted directly, or through another flow path member, and which supplies ink in the ink carriage 2 to the head main body 140. In such a flow path member 130, a supply path 131 which supplies ink in the ink carriage 2 to each head main body 140 is provided. For example, when the ink carriage 2 is directly mounted on the flow path member 130, an ink supply needle, or the like, is provided at one end of the supply path 131. In addition, in the example illustrated in FIG. 2, instead of the ink supply needle, a cylindrical protrusion portion in which the supply path 131 is provided in the inside on one face of the flow path member 130 in the third direction Z is illustrated; however, as a matter of course, it is not limited to this, and it may be an ink supply needle of which the tip is pointed in a conical shape.

Figure 6:
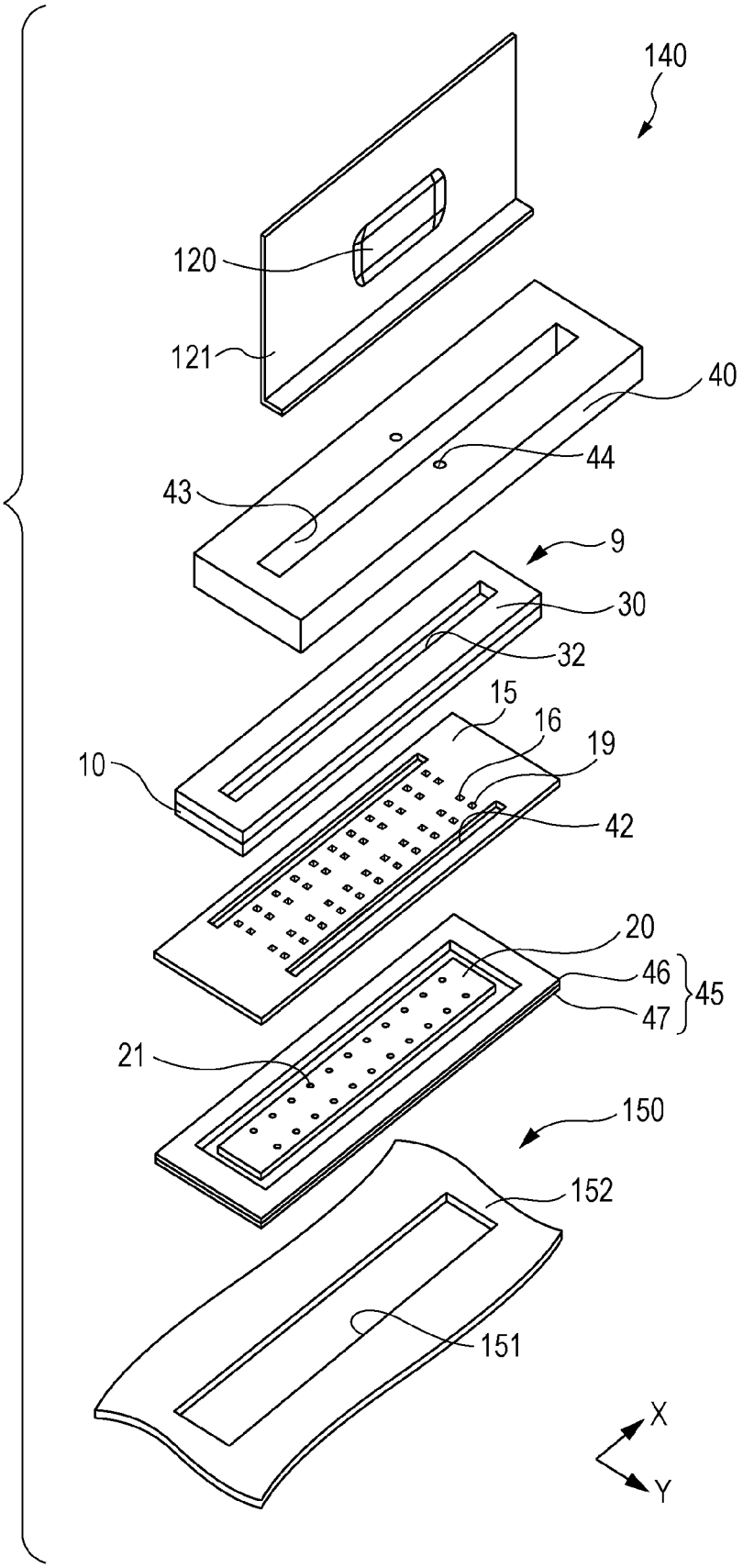
FIG. 6 is an exploded perspective view of a head main body according to the first embodiment.
Figure 7:
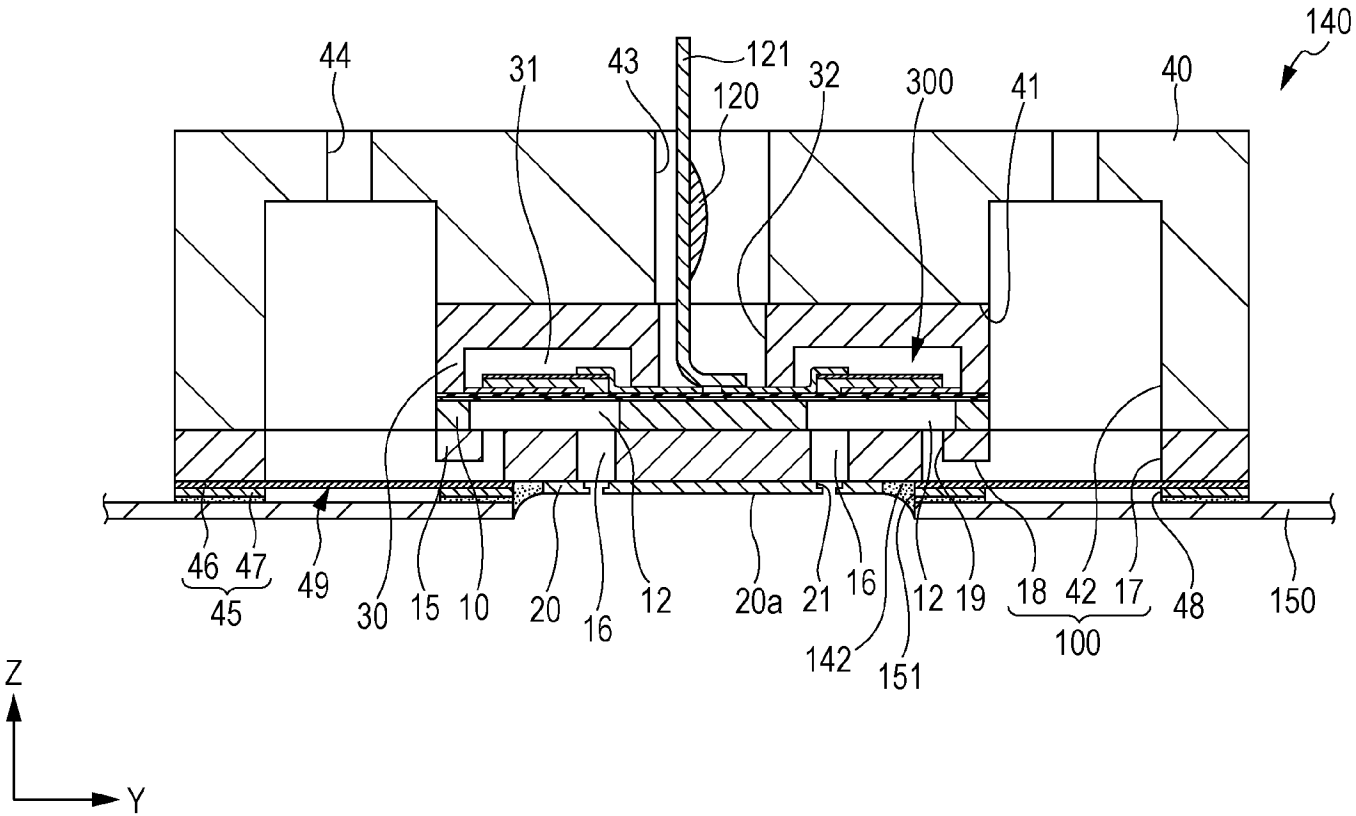
FIG. 7 is a cross-sectional view of the head main body according to the first embodiment.

Here, the head main body 140 will be further described in detail with reference to FIGS. 6 and 7. In addition, FIG. 6 is an exploded perspective view of the head main body, and FIG. 7 is a cross-sectional view of the head main body.

As illustrated, the head main body 140 according to the embodiment includes a plurality of members such as a flow path forming substrate 10, a communication plate 15, a nozzle plate 20, a protection board 30, and a case member, and these plurality of members are bonded using an adhesive, or the like.

In the flow path forming substrate 10, it is possible to use metal such as stainless steel, Ni, a ceramic material which is represented by $ZrO_2$ or $Al_2O_3$, a glass ceramic material, and an oxide such as MgO and $LaAlO_3$. According to the embodiment, the flow path forming substrate 10 is formed of a silicon single crystal substrate. In the flow path forming substrate 10, pressure generation chambers 12 which are partitioned by a plurality of partitioning walls are aligned in a direction in which a plurality of nozzle openings 21 ejecting ink are aligned by performing anisotropic etching from one surface side. According to the embodiment, the direction is also referred to as an aligning direction of the pressure generation chamber 12, and the direction matches the first direction X of the above described ink jet recording apparatus I. That is, the ink jet recording head 1 is installed in the ink jet recording apparatus I so that the aligning direction of the pressure generation chamber 12 (nozzle opening 21) becomes the first direction X. In addition, in the flow path forming substrate 10, a plurality of columns in which the pressure generation chambers 12 are aligned in the first direction X, for example, two columns in the embodiment are provided. A column direction in which the plurality of columns of the pressure generation chamber 12 in which the pressure generation chamber 12 is formed in the first direction X are provided matches the second direction Y.

In addition, in the flow path forming substrate 10, a supply path, or the like, of which an opening area is smaller than that of the pressure generation chamber 12, and which provides a flow path resistance of ink which flows into the pressure generation chamber 12 may be provided on one end portion side of the pressure generation chamber 12 in the second direction Y.

In addition, a communication plate 15 is bonded to one surface side of the flow path forming substrate 10 (stacked direction, and −Z direction). In addition, the nozzle plate 20 onto which the plurality of nozzle openings 21 which communicate with each pressure generation chamber 12 are provided in a protruding manner is bonded to the communication plate 15.

A nozzle communication path 16 which communicates with the pressure generation chamber 12 and the nozzle opening 21 is provided on the communication plate 15. The communication plate 15 has an area which is larger than the flow path forming substrate 10, and the nozzle plate 20 has an area which is smaller than the flow path forming substrate 10. In this manner, it is possible to reduce cost by making the area of the nozzle plate 20 relatively small. In addition, according to the embodiment, a face from which ink droplets are discharged when the nozzle opening 21 of the nozzle plate 20 is open is referred to as a liquid ejecting face 20*a*. In addition, according to the embodiment, the liquid ejecting face 20*a* of the nozzle plate 20 corresponds to "region in which nozzle opening is formed" which is described in claims.

In addition, a first manifold unit 17 which configures a part of a manifold 100, and a second manifold unit (throttling flow path, orifice flow path) 18 are provided on the communication plate 15.

The first manifold unit 17 is provided by penetrating the communication plate 15 in a thickness direction (stacked direction of communication plate 15 and flow path forming substrate 10).

In addition, the second manifold unit 18 is provided by opening to the nozzle plate 20 side of the communication plate 15, without penetrating the communication plate 15 in the thickness direction.

In addition, on the communication plate 15, a supply communication flow path 19 which communicates with one end portion of the pressure generation chamber 12 in the second direction Y is independently provided in each pressure generation chamber 12. The supply communication flow path 19 communicates with the second manifold unit 18 and the pressure generation chamber 12.

As the communication plate 15, it is possible to use metal such as stainless steel or Ni, or a ceramic such as zirconium. In addition, it is preferable to use a material of which a coefficient of linear expansion is the same as that of the flow path forming substrate 10 in the communication plate 15. That is, when a material of which a coefficient of linear expansion is remarkably different from that of the flow path forming substrate 10 is used, as a material of the communication plate 15, warpage occurs due to a difference in coefficient of linear expansion between the flow path forming substrate 10 and the communication plate 15 when being heated or cooled down. According to the embodiment, it is possible to suppress an occurrence of warpage, cracking, separation, or the like, due to heat using the same material as that of the flow path forming substrate 10, that is, a silicon single crystal substrate, as a material of the communication plate 15.

In addition, the nozzle openings 21 which communicate with each pressure generation chamber 12 through a nozzle communication path 16 is formed on the nozzle plate 20. That is, the nozzle openings 21 which eject the same liquid (ink) are aligned in the first direction X, and two columns of the column of the nozzle openings 21 (nozzle column) which are aligned in the first direction X are formed in the second direction Y. According to the embodiment, one face of the nozzle plate 20 in the third direction Z to which the nozzle opening 21 is open is referred to as the liquid ejecting face 20*a*.

As a material of the nozzle plate 20, for example, it is possible to use metal such as stainless steel (SUS), an organic substance such as a polyimid resin, or the silicon single crystal substrate, or the like. In addition, when using the silicon single crystal substrate as the nozzle plate 20, a coefficient of linear expansion in the nozzle plate 20 and the communication plate 15 becomes the same, and accordingly, it is possible to suppress the occurrence of warpage due to heating or cooling down, or cracking and separation due to heat.

Meanwhile, a vibrating plate 50 is formed on the opposite face side to the communication plate 15 of the flow path forming substrate 10. According to the embodiment, as the vibrating plate 50, an elastic film 51 which is formed of silicon oxide which is provided on the flow path forming substrate 10 side, and an insulator film 52 which is formed of zirconium oxide which is provided on the elastic film 51 are provided. In addition, a liquid flow path of the pressure generation chamber 12, or the like, is formed by performing anisotropic etching with respect to one surface side (face side onto which nozzle plate 20 is bonded) of the flow path forming substrate 10, and the other face of the liquid flow path of the pressure generation chamber 12, or the like, is demarcated using the elastic film 51.

In addition, according to the embodiment, on the insulator film 52 of the vibrating plate 50, a first electrode 60, a piezoelectric layer 70, and a second electrode 80 configure a piezoelectric actuator 300 by being stacked using a film forming method and a lithography method. Here, the piezoelectric actuator 300 is a portion which includes the first electrode 60, the piezoelectric layer 70, and the second electrode 80. In general, the piezoelectric actuator 300 is configured by setting any one of the electrodes to a common electrode, and by patterning the other electrode and the piezoelectric layer 70 in each pressure generation chamber 12. In addition, here, a portion which is configured of any one of the electrode which is patterned and the piezoelectric layer 70, and in which piezoelectric strain occurs due to applications of voltage to both electrodes is referred to as a piezoelectric active portion. According to the embodiment, the first electrode 60 is set to a common electrode of the piezoelectric actuator 300, and the second electrode 80 is set to an individual electrode of the piezoelectric actuator 300; however, there is no problem when being reversely set due to in circumstances of a driving circuit and wiring. In addition, in the above described example, the first electrode 60 functions as the vibrating plate, since the first electrode 60 is continuously provided over the plurality of pressure generation chambers 12; however, as a matter of course, there is no limitation to this, and for example, only the first electrode 60 may be operated as the vibrating plate without providing any one or both of the above described elastic film 51 and the insulator film 52.

In addition, the protection board 30 of which a size is approximately the same as that of the flow path forming substrate 10 is bonded onto a face on the piezoelectric actuator 300 side of the flow path forming substrate 10. The protection board 30 includes a holding portion 31 which is a space for protecting and accommodating the piezoelectric actuator 300. In addition, a through hole 32 for penetrating in the third direction Z which is the thickness direction is provided on the protection board 30. The other end portion of the lead electrode 90 which is the opposite side to one end portion connected to the second electrode 80 is extended so as to be exposed into the through hole 32, and a lead electrode 90 and a wiring member 121 on which a driving circuit 120 such as a driving IC is mounted are electrically connected in the through hole 32.

In addition, a case member 40 which demarcates the manifold 100 which communicates with the plurality of pressure generation chambers 12 along with the head main body 140 is fixed in the head main body 140 which is configured in this manner. The case member 40 has approximately the same shape as the above described communication plate 15 when planarly viewed, is bonded to the protection board 30, and is also bonded to the above described communication plate 15. Specifically, the case member 40 includes a convex portion 41 with a depth in which the flow path forming substrate 10 and the protection board 30 are accommodated on the protection board 30 side. The convex portion 41 has an opening area which is wider than a face of the protection board 30 which is bonded to the flow path forming substrate 10. In addition, an opening face on the convex portion 41 on the nozzle plate 20 side is sealed using the communication plate 15 in a state in which the flow path forming substrate 10, or the like, is accommodated in the convex portion 41. In this manner, a third manifold unit 42 is demarcated by the case member 40 and the head main body 140 on the outer peripheral portion of the flow path forming substrate 10. In addition, the manifold 100 according to the embodiment is configured of the first manifold unit 17 and the second manifold unit 18 which are provided on the communication plate 15, and the third manifold unit 42 which is demarcated by the case member 40 and the head main body 140.

In addition, as a material of the case member 40, it is possible to use, for example, a resin, metal, or the like. In addition, by molding a resin material as the case member 40, it is possible to perform a mass production at low cost.

In addition, a compliance board 45 is provided on a face of the communication plate 15 on which the first manifold unit 17 and the second manifold unit 18 are opened. The compliance board 45 seals openings of the first manifold unit 17 and the second manifold unit 18 on the liquid ejecting face 20*a* side.

According to the embodiment, the compliance board 45 includes a sealing film 46 and a fixing board 47. The sealing film 46 is formed of a flexible thin film (for example, thin film of which thickness is 20 μm or less, and which is formed using polyphenylene sulfide (PPS), stainless steel (SUS), or the like), and the fixing board 47 is formed of a hard material, for example, metal such as stainless steel (SUS). Since a region of the fixing board 47 facing the manifold 100 becomes an opening portion 48 which is completely eliminated in the thickness direction, one side face of the manifold 100 becomes a compliance unit which is a flexible unit sealed using only the sealing film 46 which is flexible.

In addition, an introducing path 44 for supplying ink to each manifold 100 by communicating with the manifold 100 is provided in the case member 40. In addition, a connection port 43 into which the wiring member 121 is inserted is provided by communicating with the through hole 32 of the protection board 30 in the case member 40.

The head main body 140 with such a configuration takes ink in from the introducing path 44 through a flow path member 130 from the ink carriage 2, when ejecting ink, and fills the flow path from the manifold 100 to the nozzle opening 21 with ink. Thereafter, the vibrating plate 50 is caused to perform flexural deformation along with the piezoelectric actuator 300 by applying a voltage to each piezoelectric actuator 300 corresponding to the pressure generation chamber 12 according to a signal from the driving circuit 120. In this manner, pressure in the pressure generation chamber 12 increases, and ink droplets are ejected from a predetermined nozzle opening 21.

As illustrated in FIGS. 2 to 5, four head main bodies 140 are fixed to the above described flow path member 130 in an aligning direction of the nozzle column, that is, in the second direction Y at a predetermined interval. That is, eight nozzle columns in which nozzle openings 21 are aligned are provided in the ink jet recording head 1 according to the embodiment. It is possible to suppress a decrease in yield compared to a case in which a plurality of nozzle columns are formed in one head main body 140, by providing a plurality of nozzle columns using a plurality of head main bodies 140 in this manner. In addition, it is possible to increase the number of head main bodies 140 which can be formed from one silicon wafer using a plurality of head main bodies 140 by providing a plurality of nozzle columns, and to reduce a manufacturing cost by reducing a useless region in the silicon wafer.

In addition, the liquid ejecting face 20*a* side of the four head main bodies 140 which are fixed to the flow path member 130 is covered using the cover head 150 which is the abutting member in the embodiment.

The cover head 150 includes an exposure opening portion 151 which exposes the liquid ejecting face 20*a* of the head main body 140, and a bonding portion 152 which demarcates the exposure opening portion 151.

Four of the exposure opening portions 151 are formed so as to independently expose the liquid ejecting face 20*a* of each head main body 140. According to the embodiment, the exposure opening portion 151 includes an opening with a size which can expose the nozzle plate 20, that is, the same opening as that of the compliance board 45.

The bonding portion 152 demarcates the exposure opening portion 151, and is provided so as to close a space between the head main bodies 140 which are neighboring in the second direction Y. In addition, the bonding portion 152 is bonded onto the opposite face side to the communication plate 15 of the compliance board 45, and covers a space on the opposite side to a flow path of a compliance unit 49 (manifold 100).

That is, the cover head 150 which is the positioning abutting unit is provided on the outer side of the liquid ejecting face 20*a* of the nozzle plate 20 which is a region in which the nozzle opening 21 according to the embodiment is formed, and the cover head 150 is arranged so as to surround the periphery of the liquid ejecting face 20*a*. In addition, since the exposure opening portion 151 of the cover head 150 is formed in an opening area which is larger than that of the nozzle plate 20, a gap is formed between an opening edge portion of the exposure opening portion 151 and the nozzle plate 20 of the head main body 140. According to the embodiment, a filling material 142 is filled in the gap between the nozzle plate 20 and the exposure opening portion 151 of the cover head 150. The filling material 142 is formed at a position which is lower than the liquid ejecting face 20*a* on the nozzle plate 20 side (opposite direction to liquid ejecting direction), and a position which is lower than the surface of the cover head 150 on the cover head 150 side. In this manner, though it will be described in detail later, when ink is suctioned from the nozzle opening 21 using the cap main body 210, or the like, ink is filled and held in the gap between the nozzle plate 20 and the opening edge portion of the exposure opening portion 151, and it is possible to prevent the held ink from contaminating a recording sheet S by falling on the recording sheet S at an unexpected timing.

In addition, the filling material 142 is not particularly limited when it is a material having liquid resistance, and for example, it is possible to use an adhesive, or the like. In addition, the filling material 142 may be a part of an adhesive which bonds the cover head 150 to the compliance board 45.

In addition, the cover head 150 includes a bent portion 153 which is provided by being bent at an end portion from the liquid ejecting face 20*a* side so as to cover the side face of the head main body 140 (face intersecting liquid ejecting face 20*a*). According to the embodiment, the bent portion 153 is provided at four portions in total, that is, on both side faces of the liquid ejecting face 20*a* in the first direction X, and on both side faces in the second direction Y. By providing the bent portion 153 in this manner, it is possible to suppress deformation of the cover head 150 by improving rigidity of the cover head 150. Incidentally, as the cover head 150, when a flat plate-shaped member in which the bent portion 153 is not provided is used, rigidity of the cover head 150 deteriorates; however, it is possible to improve rigidity of the cover head 150 compared to a flat plate-shaped cover head 150, by providing the bent portion 153 by bending the periphery of the flat plate-shaped member. In particular, according to the embodiment, though it will be described in detail later, when rigidity of the cover head 150 is low, the cover head is easily deformed, since the cap main body 210 of the maintenance unit is positioned by being in contact with the cover head; however, it is possible to make the cover head 150 be hardly deformed even when the cap main body 210 comes into contact with the cover head 150 by providing the bent portion 153. In addition, a face on the outer side of the bent portion 153 becomes an abutting face 153*a* with which a positioning face of the cap main body 210, which will be described in detail later, comes into contact.

As the cover head 150, for example, it is possible to use a metallic material such as stainless steel, a ceramic material, a glass ceramic material, an oxide, and the like.

In addition, the cover head 150 is bonded to the liquid ejecting face 20*a* side of the head main body 140 through the adhesive 141. That is, all of four head main bodies 140 are fixed to one cover head 150. According to the embodiment, the adhesive 141 is also provided between the case member 40 and the bent portion 153 by being filled. In this manner, rigidity of the cover head, and in particular, rigidity of the bent portion 153 is improved. For this reason, though it will be described in detail later, it is possible to further suppress deformation of the bent portion 153 when the cap main body 210 comes into contact with the bent portion 153 of the cover head 150. In addition, it is possible to further improve rigidity of the cover head 150 by providing the adhesive 141 between all of the bent portions 153 and the case members 40; however, it is possible to suppress deformation of the cover head 150 due to abutting of the cap main body 210 when the adhesive 141 is filled at least between the bent portion 153 with which the side wall of the cap main body 210 comes into contact and the case member 40.

According to the embodiment, the cover head 150 is provided on the recording sheet S side in a protruding manner compared to the liquid ejecting face 20*a* of the nozzle plate 20 in a discharging direction of ink (liquid). In this manner, it is difficult for the recording sheet S to come into contact with the nozzle plate 20 when the cover head 150 is caused to protrude on the recording sheet S side compared to the liquid ejecting face 20*a*, and it is possible to suppress an occurrence of deformation, separation, or the like, of the nozzle plate 20 due to the contact of the recording sheet S to the nozzle plate 20.

In addition, as described above, the ink jet recording head 1 is installed in the ink jet recording apparatus I so that the second direction Y becomes the main scanning direction which is the movement direction of the carriage 3.

Figure 8:
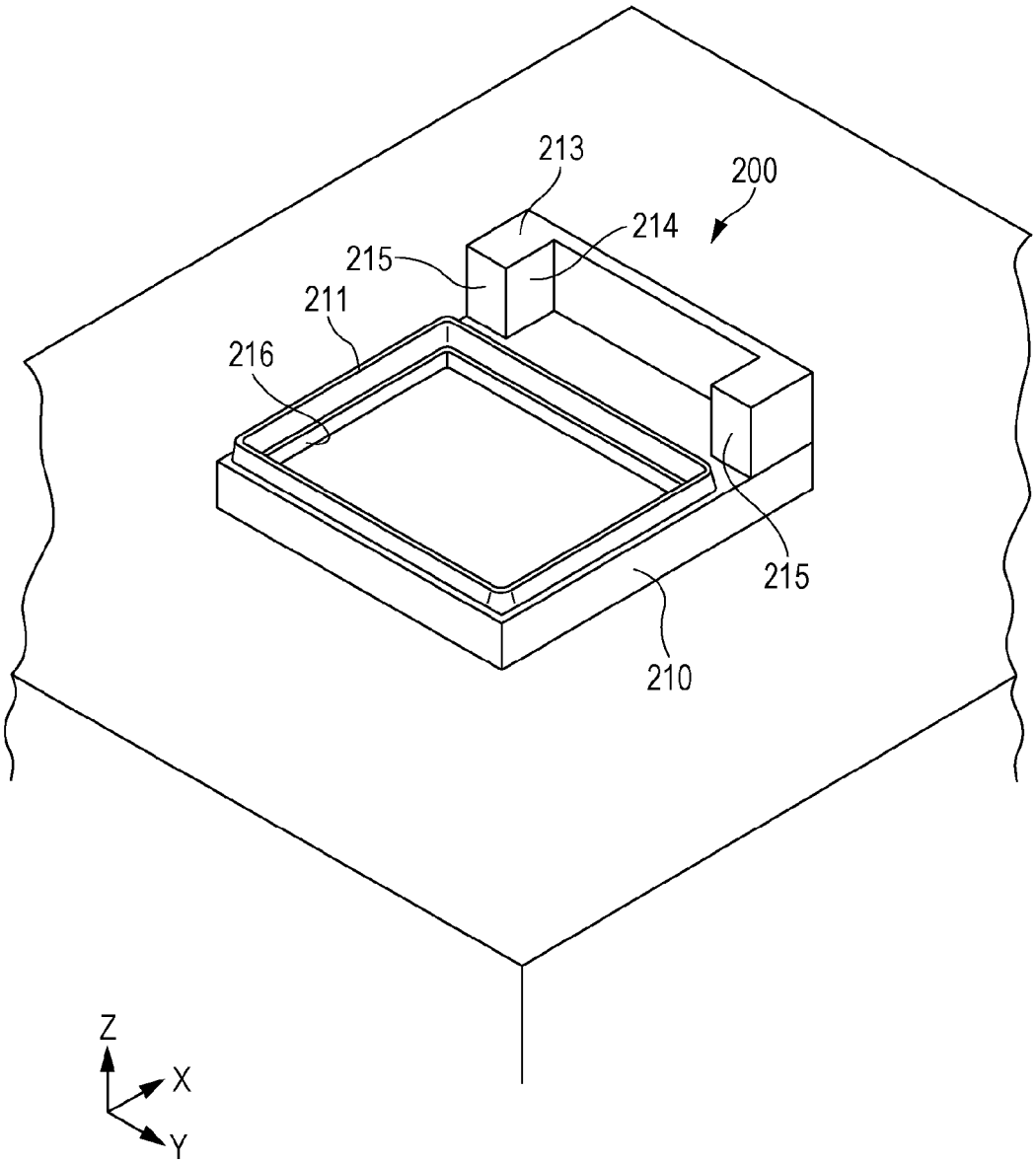
FIG. 8 is a perspective view of a cleaning unit according to the first embodiment.
Figure 9:
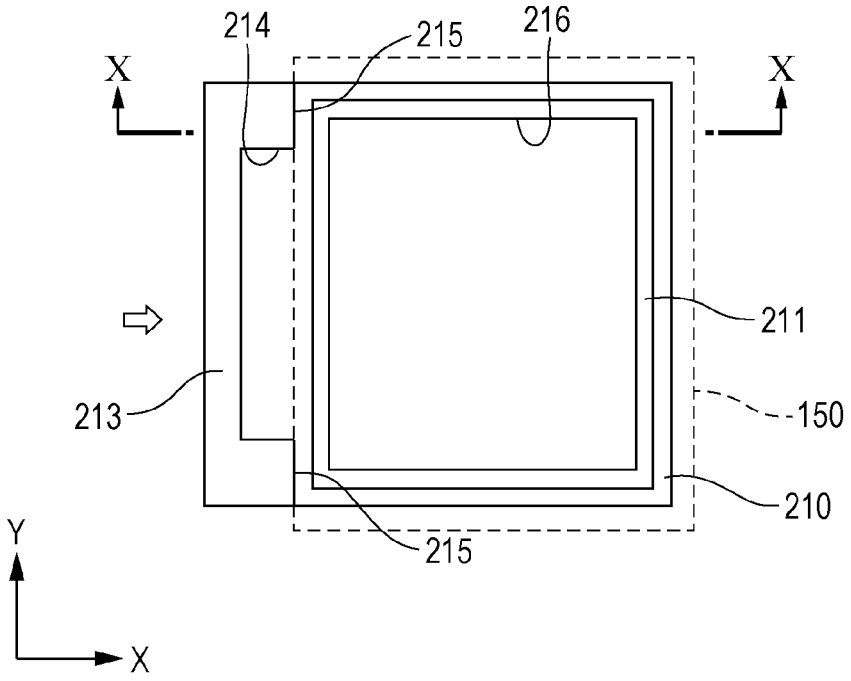
FIG. 9 is a plan view of the cleaning unit according to the first embodiment.
Figure 10:
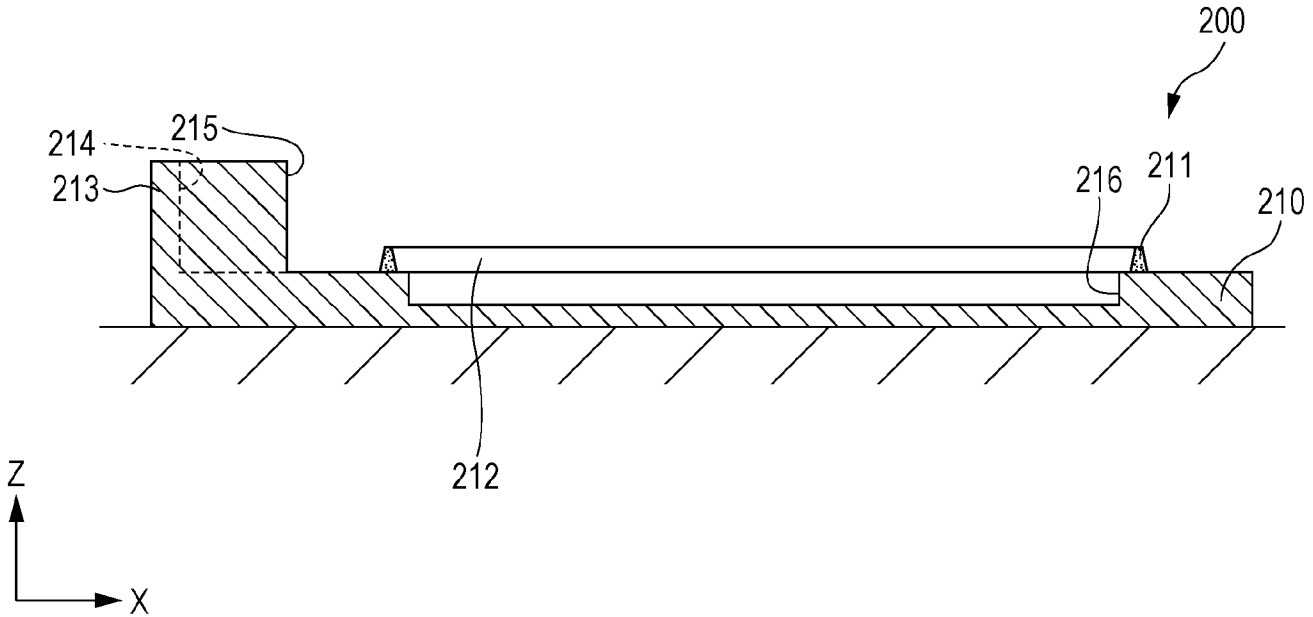
FIG. 10 is a cross-sectional view of the cleaning unit according to the first embodiment.
Figure 11:
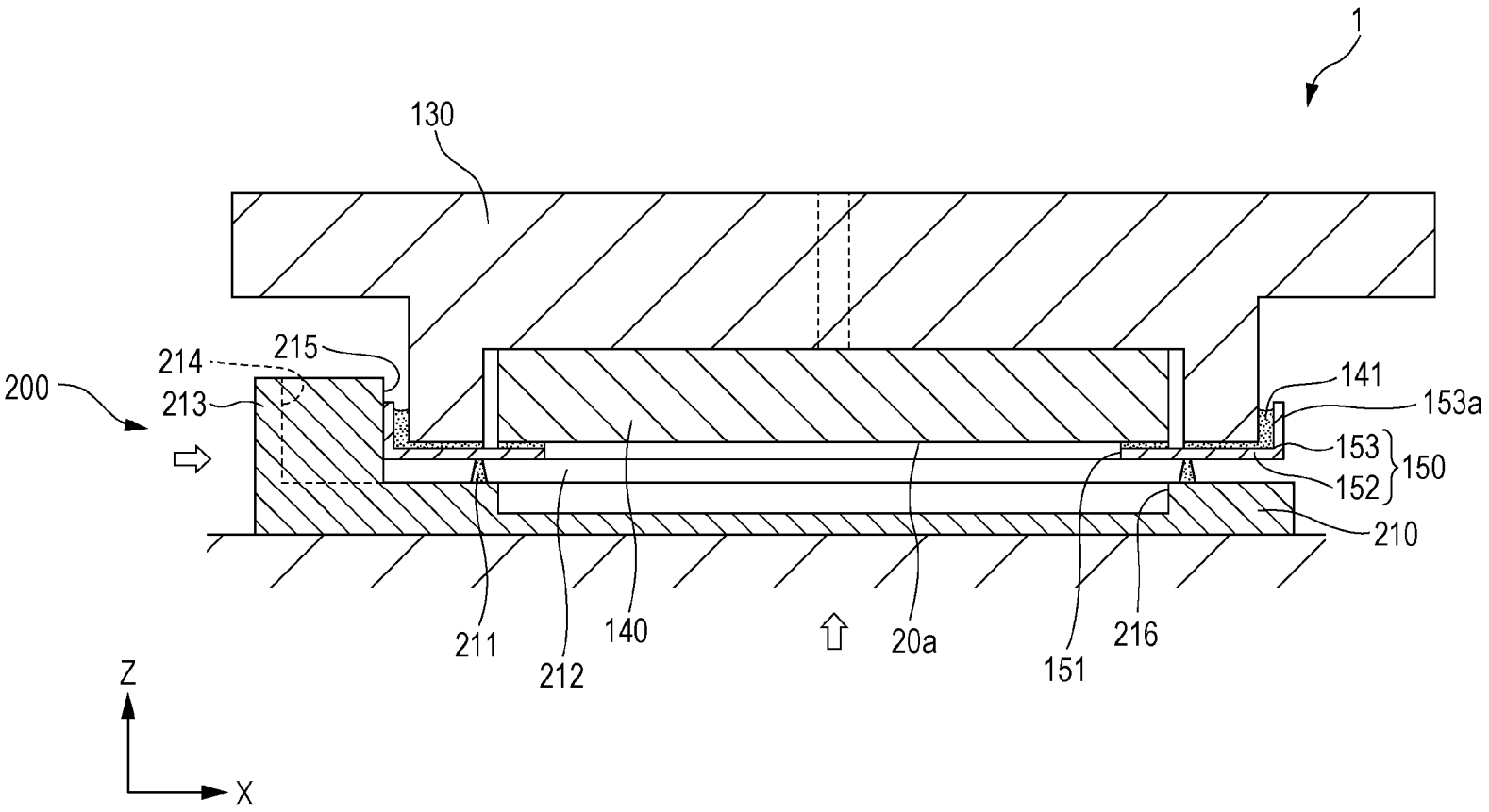
FIG. 11 is a cross-sectional view of the recording head and the cap main body according to the first embodiment.

Meanwhile, the maintenance unit 200 will be described in detail with reference to FIGS. 8 to 11. In addition, FIG. 8 is a perspective view of the cap main body according to the first embodiment of the invention, FIG. 9 is a plan view of the cap main body, FIG. 10 is a cross-sectional view which is taken along line X-X of FIG. 9, and FIG. 11 is a cross-sectional view of the ink jet recording head and the cap main body.

As illustrated, the maintenance unit 200 includes the cap main body 210 in an approximately rectangular box shape, and a plurality of sealing members 211 in an annular rectangular shape are formed so as to configure a cap opening portion on the higher face side (third direction Z) of the cap main body 210. The sealing member 211 is formed in a size which covers the liquid ejecting face 20*a* of four head main bodies 140. That is, according to the embodiment, the sealing member 211 is formed in a size which comes into contact with a face on the recording sheet S side of the cover head 150 which is the positioning abutting unit in the third direction Z. That is, the sealing member 211 is formed in a size which includes four exposure opening portions 151 which are provided in the cover head 150. In this manner, the sealing member 211 forms a sealed space 212 (refer to FIG. 11) inside the cap main body 210 by coming into contact with the face on the recording sheet S side of the bonding portion 152 of the cover head 150. In addition, the sealing member 211 may be individually provided in each head main body 140. That is, four sealing members 211 which form an independent sealed space 212 in each of four exposure opening portions 151 may be provided.

In addition, the cap main body 210 includes a side wall 213 which protrudes on the ink jet recording head 1 side in the third direction Z. According to the embodiment, the side wall 213 is provided in the third direction Z in a protruding manner on one side of the cap main body 210 in the first direction X which is the transport direction. A concave portion 214 which opens to the sealing member 211 side is provided along the third direction Z on the side wall 213, and two positioning faces 215 are provided on both sides of the concave portion 214 of the side wall 213, that is, on both sides in the second direction Y.

In addition, a holder unit 216 in a concave shape is provided inside the cap main body 210 on the sealing member 211 side. In the holder unit 216, though it is not particularly illustrated, a liquid absorber, or the like, which is formed of a porous material, or the like, is held, and absorbs and holds ink which is suctioned from the nozzle opening 21.

In addition, in the maintenance unit 200, an elevator (not illustrated) for elevating the cap main body 210 in the third direction Z is provided. In addition, when the cap main body 210 is raised using the elevator in the third direction Z in a state in which the carriage 3 is moved to the home position, the higher end of the sealing member 211 comes into close contact with the cover head 150 of the ink jet recording head 1, and all of the nozzle openings 21 are covered using the sealing member 211 of the cap main body 210. In addition, the elevator (not illustrated) is provided so as to move the cap main body 210 in the second direction Y with respect to the ink jet recording head 1, and when the cap main body 210 is moved using the elevator, the cap main body 210 is positioned in the second direction Y with respect to the ink jet recording head 1.

Specifically, the positioning in the second direction Y in the embodiment in the in-plane direction of the liquid ejecting face 20*a* of the ink jet recording head 1 and the cap main body 210 is performed when two positioning faces 215 which are inside faces of the side wall 213 on the sealing member 211 side come into contact with the abutting face 153*a* on the outer side of the bent portion 153 of the cover head 150. That is, the cap main body 210 is moved in the second direction Y, and the positioning face 215 of the side wall 213 is caused to perform plane contact with the abutting face 153*a* on the outer side of the bent portion 153 of the cover head 150 in the second direction Y. In this manner, positions of the cap main body 210 and the cover head 150 in the second direction Y are defined. That is, the positioning face 215 of the side wall 213 and the sealing member 211 are positioned, and it is possible to perform positioning of the sealing member 211 at an abutting position of the cover head 150 with high accuracy, by causing the positioning face 215 to come into contact with the abutting face 153*a* of the cover head 150. That is, the sealing member 211 is positioned at the bonding portion 152 of the cover head 150 through the side wall 213 of the cap main body 210 and the bent portion 153 of the cover head 150. For this reason, it is possible to position the sealing member 211 of the cap main body 210 at the cover head 150 with high accuracy.

In contrast to this, for example, when the sealing member 211 is caused to come into direct contact with the liquid ejecting face 20*a* of the nozzle plate 20, since the sealing member 211 is interposed between four members of the cap main body 210, the cover head 150, the compliance board 45, and the communication plate 15 in order to reach the nozzle plate 20, a big error may easily occur at a position at which the sealing member comes into contact, since a dimensional tolerance in each member and mutual positioning errors are integrated. In addition, when there is a big error at the position with which the sealing member 211 comes into contact, it is not possible to reliably cover all of the nozzle openings 21 using the sealing member 211, and there is a concern that faulty cleaning, or the like, of the nozzle opening 21 may occur. In addition, in order to reliably cover all of the nozzle openings 21 even when the position of the sealing member 211 is shifted, it is necessary to provide a large region with which the sealing member 211 comes into contact in advance, and as a result, the nozzle plate 20 becomes large, and the ink jet recording head 1 becomes large, as well. In particular, when the liquid ejecting face 20*a* in the first direction X which is the transport direction of the recording sheet S becomes large, a distance to a transport unit (not illustrated) which is provided by interposing the ink jet recording head 1 increases in the transport direction of the recording sheet S, and it is difficult to control fixing of the recording sheet S. According to the embodiment, since there is only one interposing member of the cap main body 210 until the sealing member 211 reaches the cover head 150 with which the sealing member 211 comes into contact, there is no big error even when dimensional tolerances in components and mutual positioning errors are integrated. Accordingly, it is not necessary to arrange an abutting region with respect to the ink jet recording head 1 by taking the position shift in the sealing member 211 into consideration, and it is possible to realize miniaturization of the ink jet recording head 1. In particular, according to the embodiment, in the first direction X which is a transport direction, since it is possible to perform highly accurate positioning of the sealing member 211 and the ink jet recording head 1, by making a distance between the transport units (not illustrated) which are provided by interposing the ink jet recording head 1 therebetween short, and by performing a fixing control of the recording sheet S easily, it is possible to suppress a printing failure due to a shift in landing position, or the like, and to miniaturize the ink jet recording apparatus I by preventing the transport unit from becoming large.

In addition, according to the embodiment, since two positioning faces 215 are provided, and are caused to come into contact with both end sides of the abutting face 153*a* of the bent portion 153 in the first direction X which is provided on one side in the second direction Y, it is possible to perform highly accurate positioning of the sealing member 211 in the rotation direction. Incidentally, it is also possible to form the positioning face 215 in a size in which the positioning face comes into contact with the entire face of the abutting face 153*a*; however, when an area of the positioning face 215 becomes large, it is difficult to form the positioning face 215 with high plane accuracy. In addition, when only one positioning face 215 with a small area is provided, there is a concern that positioning accuracy in a rotation direction in which an abutting portion is set to a fulcrum may be lowered, in a state in which the positioning face 215 comes into contact with the abutting face 153*a*. According to the embodiment, it is possible to easily form the positioning face with high plane accuracy by reducing the area of the positioning face 215, and to improve positioning accuracy in the rotation direction, by providing two positioning faces 215 which come into contact with one abutting face 153*a* at positions which are separated in the first direction X.

In addition, a suction unit such as a suction pump (not illustrated) is connected to the holder unit 216 of the cap main body 210, and the cap main body 210 forms the sealed space 212 which communicates with the holder unit 216 by causing the sealing member 211 to come into contact with the cover head 150, seals the space, sets the holder unit 216 and the inside of the sealed space 212 to be in a negative pressure state using suction of a suction unit thereafter, and performs a suctioning operation (cleaning operation) by suctioning ink in a flow path of the ink jet recording head 1 from the nozzle opening 21 along with air bubbles. In addition, when printing is not performed, it is possible to suppress drying of ink in the vicinity of the nozzle opening 21 by covering the nozzle opening 21 using the sealing member 211 of the cap main body 210.

In addition, according to the embodiment, since the bent portion 153 of the cover head 150 with which the positioning face 215 of the side wall 213 comes into contact is filled with the adhesive 141 between the bent portion and the case member 40, rigidity of the bent portion 153 is improved. Accordingly, when the positioning face 215 comes into contact with the bent portion 153, it is possible to suppress a position shift due to the deformation of the bent portion 153 by suppressing deformation of the bent portion 153, that is, a change in angle of the bent portion 153. In addition, since the positioning face 215 makes plane contact with the abutting face 153*a*, it is possible to maintain positioning with high accuracy for a long time by preventing the side wall 213 of the cap main body 210 and the cover head 150 from being rubbed or damaged, by being in contact with each other, and by suppressing a position shift due to the damage in the side wall and the cover head.

In addition, though it is not particularly illustrated, a blade member, or the like, which is formed of an elastic member such as rubber which wipes the liquid ejecting face 20*a*, or a face on the recording sheet S side of the cover head 150 may be provided in the maintenance unit 200. By providing such a blade member, it is possible to maintain a meniscus of ink of the nozzle opening 21 preferably by wiping the liquid ejecting face 20*a* using the blade member, after performing capping of the ink jet recording head 1 using the cap main body 210.

Second Embodiment

Figure 12:
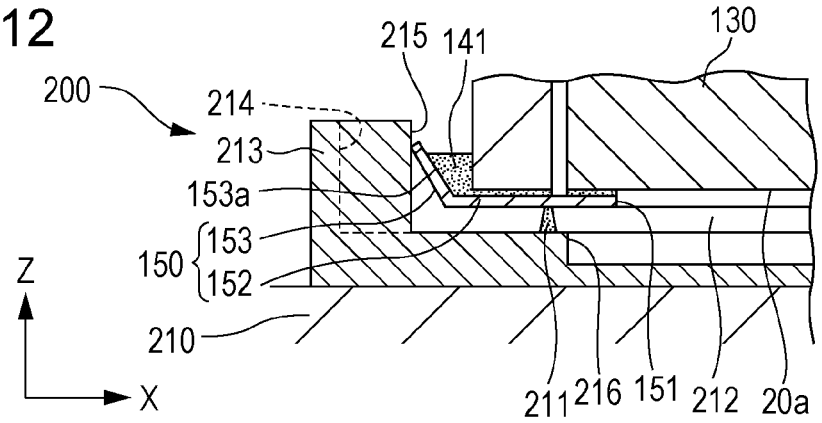
FIG. 12 is an enlarged cross-sectional view of main portions of a recording head and a cap main body according to a second embodiment.

FIG. 12 is a cross-sectional view of the ink jet recording head which is an example of a liquid ejecting head according to a second embodiment of the invention and a cap main body. In addition, the same members as those in the above described first embodiment will be given the same reference numerals, and redundant descriptions will be omitted.

As illustrated in FIG. 12, a bent portion 153 of a cover head 150 which is a positioning abutting unit is provided so as to bend in a direction which is inclined in the third direction Z. According to the embodiment, the bent portion 153 is provided so as to be bent in a direction which is separated from a case member 40 while being separated from a liquid ejecting face 20*a*. In addition, an adhesive 141 is filled between the bent portion 153 and the case member 40 in the embodiment, similarly to the above described first embodiment, and rigidity of the bent portion 153 is improved by the adhesive 141.

When positioning a cap main body 210 in the ink jet recording head 1, the positioning is performed by causing a positioning face 215 of a side wall 213 to come into contact with a tip end of the bent portion 153, that is, an end portion of the bent portion 153 on the side opposite to the liquid ejecting face 20*a*. At this time, since the positioning face 215 and the bent portion 153 make line contact not plane contact with each other, it is possible to perform positioning of the cap main body 210 with respect to the bent portion 153 with high accuracy. That is, when the positioning face 215 and an abutting face 153*a* of the bent portion 153 are positioned by making plane contact with each other as in the above described first embodiment, the positioning face 215 and the abutting face 153*a* should be formed with high plane accuracy; however, according to the embodiment, high plane accuracy of the bent portion 153 is not necessary by causing the positioning face 215 and the bent portion 153 to make line contact not plane contact. Accordingly, since it is enough to set the accuracy only at a position of a tip end portion to be highly accurate, it is possible to perform positioning of the sealing member 211 of the cap main body 210 and the cover head 150 with high accuracy by simplifying manufacturing processes.

Figure 13:
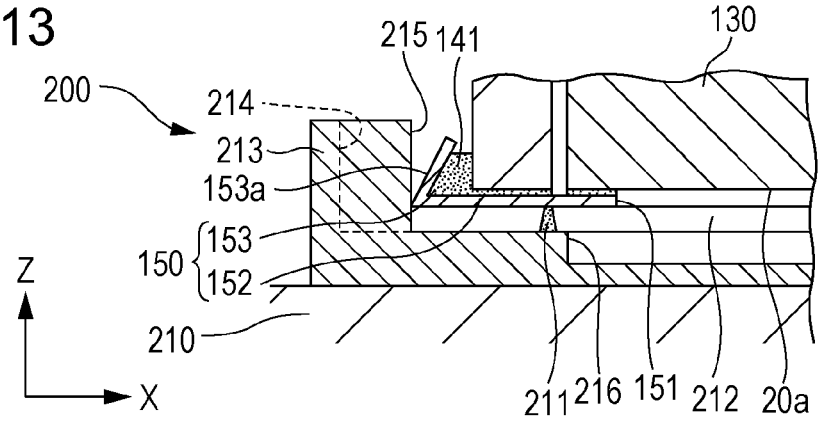
FIG. 13 is an enlarged cross-sectional view of the main portions of the recording head and the cap main body according to the second embodiment.

In addition, according to the embodiment, the bent portion 153 is bent in an angle which is separated from the case member 40 between the liquid ejecting face 20*a* and the case member 40 side in the third direction Z; however, it is not particularly limited to this. For example, as illustrated in FIG. 13, the bent portion 153 may be bent so as to be close to the case member 40 between the liquid ejecting face 20*a* and the case member 40 side in the third direction Z. Even in this case, it is possible to cause the positioning face and the liquid ejecting face 20*a* side of the bent portion 153, that is, a bent region of the bent portion 153 and the bonding portion 152 to make line contact, and to exhibit the same effect as that in the above described configuration.

Third Embodiment

Figure 14:
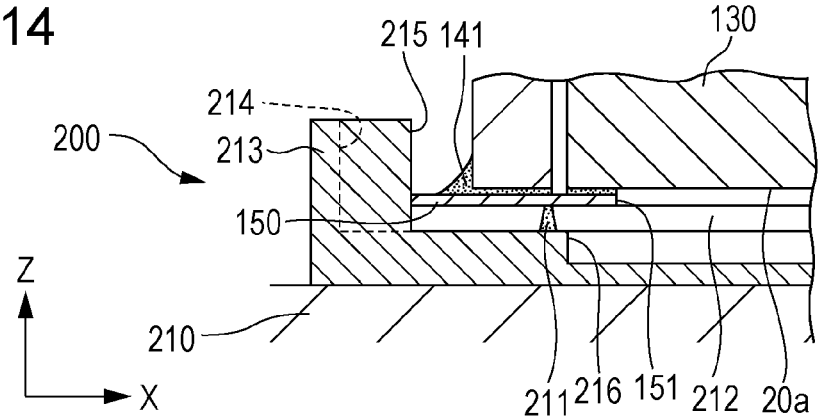
FIG. 14 is an enlarged cross-sectional view of main portions of a recording head and a cap main body according to a third embodiment.

FIG. 14 is a cross-sectional view of an ink jet recording head which is an example of the liquid ejecting head of the invention and a cap main body. In addition, the same members as those in the above described embodiment will be given the same reference numerals, and redundant descriptions will be omitted.

As illustrated in FIG. 14, a bent portion 153 is not provided in a cover head 150 of an ink jet recording head 1. However, a bonding portion 152 is formed in an area which is larger than a face on the liquid ejecting face 20*a* side of a flow path member 130, and is provided so as to protrude in the second direction Y compared to the flow path member 130 in the second direction Y.

In addition, an adhesive 141 is provided at a corner portion which is formed of the bonding portion 152 and the flow path member 130, and rigidity in a region which protrudes compared to the flow path member 130 of the bonding portion 152 is improved using the adhesive 141.

A positioning face 215 of a side wall 213 of a cap main body 210 comes into contact with the cover head 150 of the ink jet recording head 1. That is, the positioning face 215 comes into contact with an end portion of the bonding portion 152 of the cover head 150. Even in such a configuration, it is possible to position a sealing member 211 with high accuracy with respect to the cover head 150.

Other Embodiments

Hitherto, each embodiment of the invention has been described; however, a basic configuration of the invention is not limited to the above described configuration.

Figure 15:
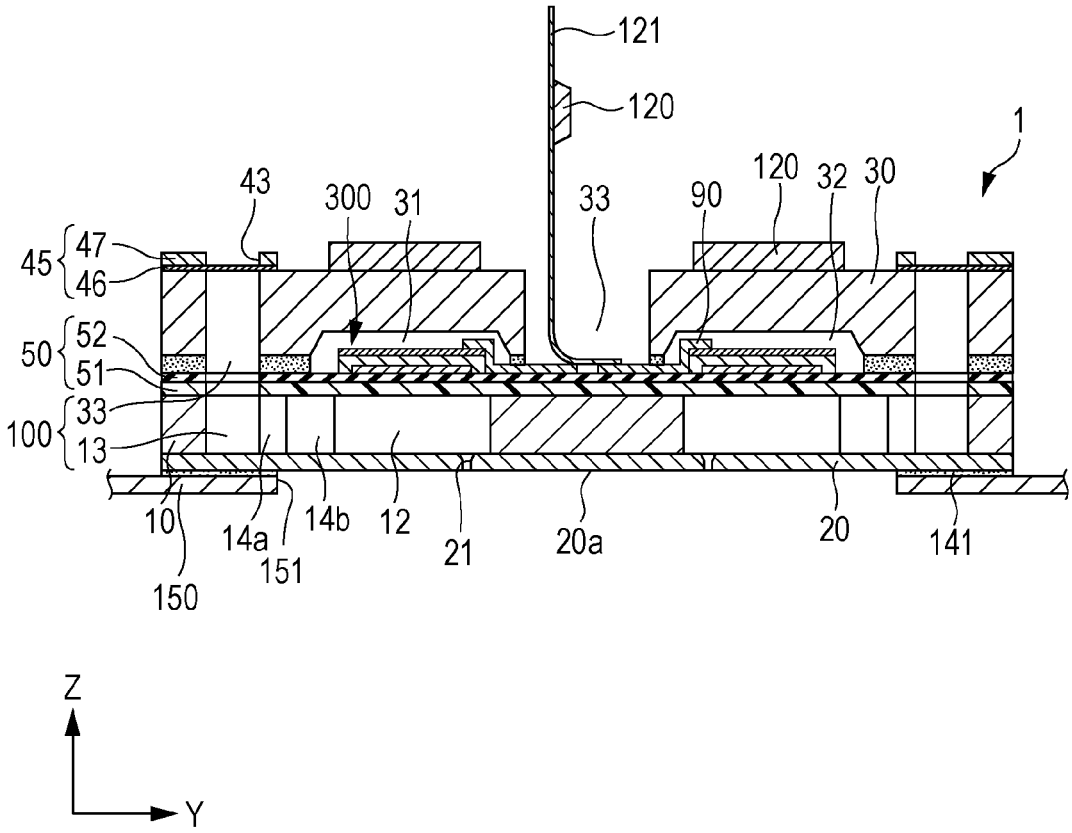
FIG. 15 is a cross-sectional view of a recording head according to another embodiment.

For example, in the ink jet recording head 1 in the above described first to third embodiments, a configuration in which a gap is formed between the cover head 150 which is the positioning abutting unit and the nozzle plate 20, and both are not bonded to each other is exemplified; however, it is not particularly limited to this. Here, another example of the ink jet recording head is illustrated in FIG. 15. In addition, FIG. 15 is a cross-sectional view of the ink jet recording head according to another embodiment.

As illustrated in FIG. 15, in the ink jet recording head 1, a nozzle plate 20 is directly bonded to a flow path forming substrate 10. That is, a communication plate 15 is not provided between the flow path forming substrate 10 and the nozzle plate 20, and an opening on the opposite side to a piezoelectric actuator 300 of the flow path forming substrate 10 is sealed using the nozzle plate 20. In such a flow path forming substrate 10, a pressure generation chamber 12, a first manifold unit 13 which configures a part of a manifold, and an ink supply path 14*a* and a communication path 14*b* which communicate with the first manifold unit 13 and the pressure generation chamber 12 are provided. The ink supply path 14*a* is formed with a width which is smaller than that of the pressure generation chamber 12 in the first direction X, and constantly maintains a flow path resistance of ink which flows into the pressure generation chamber 12 from the first manifold unit 13. The communication path 14*b* is formed in a size of which a cross-sectional area in the first direction X is the same as that of the pressure generation chamber 12. The pressure generation chamber 12, the first manifold unit 13, the ink supply path 14*a*, and the communication path 14*b* are provided so as to penetrate the flow path forming substrate 10 in the third direction Z which is the thickness direction, and one opening thereof is sealed using the nozzle plate 20, and the other opening is sealed using a vibrating plate 50.

In addition, the protection board 30 is bonded to a face on the piezoelectric actuator 300 side of the flow path forming substrate 10. The second manifold unit 33 which configures a part of the manifold 100 is formed on the protection board 30. The second manifold unit 33 is provided by penetrating the protection board 30 in the thickness direction, and the manifold 100 according to the embodiment is configured of the first manifold unit 13 of the flow path forming substrate 10, and the second manifold unit 33 of the protection board 30.

In addition, the compliance board 45 which seals the manifold 100 is provided on the protection board 30.

In addition, similarly to the above described first to third embodiments, the cover head 150 in which the exposure opening portion 151 is provided is bonded to the nozzle plate 20. That is, in the example illustrated in FIG. 15, the cover head 150 is bonded to the liquid ejecting face 20*a* of the nozzle plate 20.

In such a configuration, a part of the liquid ejecting face 20*a* of the nozzle plate 20 which is exposed by the exposure opening portion 151 of the cover head 150 corresponds to "a region in which a nozzle opening is formed" which is described in claims. That is, the region in which the nozzle opening 21 is formed, and the positioning abutting unit include a configuration of being arranged by being separated from each other with a gap therebetween, as in the above described first to third embodiments, and also a configuration of being continuous by being in contact, directly, as described in FIG. 15.

In addition, in the above described example, the cover head 150 has been exemplified as the positioning abutting unit; however, it is not limited to this, and the positioning abutting unit may be the nozzle plate 20. That is, it may be a configuration in which a part of the nozzle plate 20 is extended, and a part of the extended nozzle plate 20 comes into contact with the side wall 213 of the cap main body 210. In this case, as a matter of course, the sealing member 211 of the cap main body 210 may form the face on the recording sheet S side of the nozzle plate 20, that is, the sealed space 212 by being in direct contact with the liquid ejecting face 20*a*.

In addition, in each of the above described embodiments, the carriage 3 in which the ink jet recording head 1 is installed moves to the home position in the second direction Y, the cap main body 210 moves in the first direction X thereafter, and the side wall 213 is caused to come into contact with the cover head 150 of the ink jet recording head 1; however, it is not particularly limited to this, and for example, it may be a configuration in which the cover head 150 is caused to come into contact with the side wall 213 of the cap main body 210 using the movement of the ink jet recording head 1. In addition, the position of the side wall 213 is not particularly limited, and may be provided on one side in the second direction Y which is the movement direction of the carriage 3. In addition, by providing the side wall 213 at two portions which are one side in the first direction X and one side in the second direction Y, it is also possible to perform positioning of the cap main body 210 and the ink jet recording head 1 in the first direction X and the second direction Y with high accuracy.

In addition, the ink jet recording apparatus I in each of the above described embodiments has been exemplified as an apparatus in which the ink jet recording head 1 is installed in the carriage 3, and moves in the main scanning direction; however it is not particularly limited to this, and for example, it is also possible to apply the invention to a so-called line-type recording apparatus which performs printing only by moving a recording sheet S such as paper in the sub-scanning direction by fixing the ink jet recording head 1.

In addition, in each of the above described embodiments, as a pressure generation unit which causes a pressure change in the pressure generation chamber 12, the piezoelectric actuator 300 in a thin film shape has been used; however, it is not particularly limited to this, and for example, it is possible to use a piezoelectric actuator in a thin film shape which is formed using a method of pasting a green sheet, or the like, a vertical vibration-type piezoelectric actuator in which a piezoelectric material and an electrode forming material are alternately stacked, and are stretched in an axial direction, or the like. In addition, as the pressure generation unit, it is possible to use a unit in which liquid droplets are ejected from a nozzle opening using bubbles which are generated due to a heat generation of a heat generating element, by arranging the heat generating element in the pressure generation chamber, a so-called electrostatic actuator in which liquid droplets are discharged from a nozzle opening by generating static electricity between a vibrating plate and an electrode, and by deforming the vibrating plate using a force of the static electricity, or the like.

In addition, the invention is for overall liquid ejecting apparatuses which includes a liquid ejecting head in a broad sense, and for example, the invention can also be used in recording heads such as various ink jet recording heads which are used in an image recording apparatus such as a printer, a coloring material ejecting head which is used when manufacturing a color filter such as a liquid crystal display, an organic EL display, an electrode material ejecting head which is used when forming an electrode such as a field emission display (FED), a bio-organic material ejecting head which is used when manufacturing a biochip, and the like.

What is claimed is:

1. A liquid ejecting apparatus comprising:

a liquid ejecting head including a liquid ejecting face, on which a nozzle opening which ejects liquid toward a medium is formed, and a positioning abutting unit which is arranged on an outer side of a region in which a plurality of the nozzle openings are formed;

a cap main body which is arranged so as to relatively move with respect to the liquid ejecting head, and has a side wall which erects in a direction intersecting the liquid ejecting face, the side wall being bifurcated with a first portion separated from a second portion in a direction which goes along a plane direction of the liquid ejecting face; and a sealing member which is arranged by being accommodated inside the cap main body, comes into contact with the positioning abutting unit in a state of surrounding the region due to the relative movement of the liquid ejecting head and the cap main body, and forms a sealed space in an inside of the cap main body, wherein the combination of the first portion and the second portion of the side wall of the cap main body coming into contact with both the positioning abutting unit on one side, in the direction which goes along a plane direction of the liquid ejecting face and intersects a transport direction of the medium, and the side wall of the cap main body coming into contact with the positioning abutting unit in the transport direction of the medium, positions the liquid ejecting head and the sealing member with respect to each other, in a direction which goes along the liquid ejecting face.

2. The liquid ejecting apparatus according to claim 1, wherein the positioning abutting unit is arranged so as to surround the region, and includes a bent portion at an end portion corresponding to one side in a direction which goes along the plane direction of the liquid ejecting face.

3. The liquid ejecting apparatus according to claim 2, wherein the positioning abutting unit includes the bent portion, and an abutting face which comes into contact with an inside of the side wall.

4. The liquid ejecting apparatus according to claim 1, wherein the side wall comes into contact with the positioning abutting unit on one side of a relative movement direction between the liquid ejecting head and the medium for ejecting.

5. The liquid ejecting apparatus according to claim 1, wherein the positioning abutting unit includes an exposure opening portion which can expose the liquid ejecting face, and the exposure opening portion and the liquid ejecting face are arranged with a gap therebetween in an in-plane direction of the liquid ejecting face.

6. The liquid ejecting apparatus according to claim 1, wherein the positioning abutting unit includes the liquid ejecting face.

7. The liquid ejecting apparatus according to claim 1, wherein the wall is a side wall and includes a concave portion being concave in a direction which goes along a plane direction of the liquid ejecting face and in the transport direction.

* * * * *